US012123672B1

(12) United States Patent
Houck, Jr. et al.

(10) Patent No.: US 12,123,672 B1
(45) Date of Patent: Oct. 22, 2024

(54) MODULAR TUBE-STOWABLE RIFLE MOUNT

(71) Applicants: Thomas Klebert Houck, Jr., Woodford, VA (US); Matthew Thomas Buckler, Fredericksburg, VA (US); Timothy Gerald Burcham, Fredericksburg, VA (US); Kyle J. Campbell, Culpepper, VA (US); Ryan G. Braughler, Alexandria, VA (US); Yui Jean Clifford, Falmouth, VA (US); Jonathan E. Scroggins, Fredericksburg, VA (US); Zachary James Salvato, Fredericksburg, VA (US); Steven James Walton, Mechanicsville, VA (US)

(72) Inventors: Thomas Klebert Houck, Jr., Woodford, VA (US); Matthew Thomas Buckler, Fredericksburg, VA (US); Timothy Gerald Burcham, Fredericksburg, VA (US); Kyle J. Campbell, Culpepper, VA (US); Ryan G. Braughler, Alexandria, VA (US); Yui Jean Clifford, Falmouth, VA (US); Jonathan E. Scroggins, Fredericksburg, VA (US); Zachary James Salvato, Fredericksburg, VA (US); Steven James Walton, Mechanicsville, VA (US)

(73) Assignee: United States of America, as represented by the Secretary of the Navy, Arlington, VA (US)

( * ) Notice: Subject to any disclaimer, the term of this patent is extended or adjusted under 35 U.S.C. 154(b) by 0 days.

(21) Appl. No.: 18/211,779

(22) Filed: Jun. 20, 2023

(51) Int. Cl.
*F41A 27/24* (2006.01)

(52) U.S. Cl.
CPC ..... *F41A 27/24* (2013.01)

(58) Field of Classification Search
CPC ..... F41A 23/20; F41A 23/22; F41A 27/22; F41A 27/24
USPC ..... 89/38
See application file for complete search history.

(56) References Cited

U.S. PATENT DOCUMENTS 2,870,678 A * 1/1959 Girouard ..... F41F 3/04 89/46
3,401,598 A * 9/1968 Sons, Jr. ..... F41A 23/24 89/40.03
4,128,041 A * 12/1978 Schulz ..... F41A 27/24 89/37.11
5,677,506 A * 10/1997 Wallin ..... F41A 23/22 89/37.06

(Continued)

*Primary Examiner* — Bret Hayes
(74) *Attorney, Agent, or Firm* — Gerhard W. Thielman

(57) ABSTRACT

A rifle actuation mechanism is provided for alternately positioning a rifle between stowage within a cylindrical tube having a longitudinal axis and deployment for engaging a target. The mechanism includes a cradle, a yoke, and longitudinal, elevation and azimuth actuators. The cradle holds and fires the rifle. The yoke connects to the cradle. The longitudinal actuator translates the yoke along the axis. The elevation actuator pivots the cradle from the yoke. The azimuth actuator turns the cradle about the axis for pointing to the target. The tube contains the rifle, the cradle, the yoke and the actuators while in stowage. In preferred embodiments, the axis is substantially vertical.

5 Claims, 16 Drawing Sheets

(56) References Cited

U.S. PATENT DOCUMENTS

| | | | | |
|---|---|---|---|---|
| 5,911,172 | A * | 6/1999 | Korolenko | F41A 23/22<br>114/319 |
| 6,237,462 | B1 * | 5/2001 | Hawkes | F41A 23/12<br>89/41.17 |
| 2005/0066806 | A1 * | 3/2005 | Helms | F41A 23/20<br>89/38 |
| 2008/0202326 | A1 * | 8/2008 | Carroll | F41A 23/12<br>89/37.01 |
| 2010/0071540 | A1 * | 3/2010 | Cazalieres | F41A 23/20<br>89/41.01 |
| 2012/0152092 | A1 * | 6/2012 | Skurdal | F41F 3/042<br>89/1.819 |
| 2014/0116234 | A1 * | 5/2014 | Jacq | F41G 5/06<br>89/1.11 |

* cited by examiner

MODULAR TUBE-STOWABLE RIFLE MOUNT

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to rifle mounts. In particular, the invention relates to a platform for alternate stowage and deployment .50 cal rifle.

SUMMARY

Conventional rifle mounts yield disadvantages addressed by various exemplary embodiments of the present invention. In particular, various exemplary embodiments provide a rifle actuation mechanism for alternately positioning a rifle between stowage within a cylindrical tube having a longitudinal axis and deployment for engaging a target.

The mechanism includes a cradle, a yoke, and longitudinal, elevation and azimuth actuators. The cradle holds and fires the rifle. The yoke connects to the cradle. The longitudinal actuator translates the yoke along the axis. The elevation actuator pivots the cradle from the yoke. The azimuth actuator turns the cradle about the axis for pointing to the target. The tube contains the rifle, the cradle, the yoke and the actuators while in stowage. In preferred embodiments, the axis is substantially vertical.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

The disclosure generally employs quantity units with the following abbreviations: length in millimeters (mm) or inches ("), mass in grams (g), time in seconds(s), angles in degrees) (°) and force in newtons (N). Supplemental measures can be derived from these, such as density in grams-per-cubic-centimeters (g/cm$^3$), moment of inertia in gram-square-centimeters (kg-m$^2$) and the like.

Various exemplary embodiments provide a mount platform for a .50 caliber rifle capable of alternately stowing and deploying such a projectile launch weapon on command. Such a platform can facilitate active defense for a lightly armed vessel against a hostile target with minimal obstruction and exposure.

Figure 1:
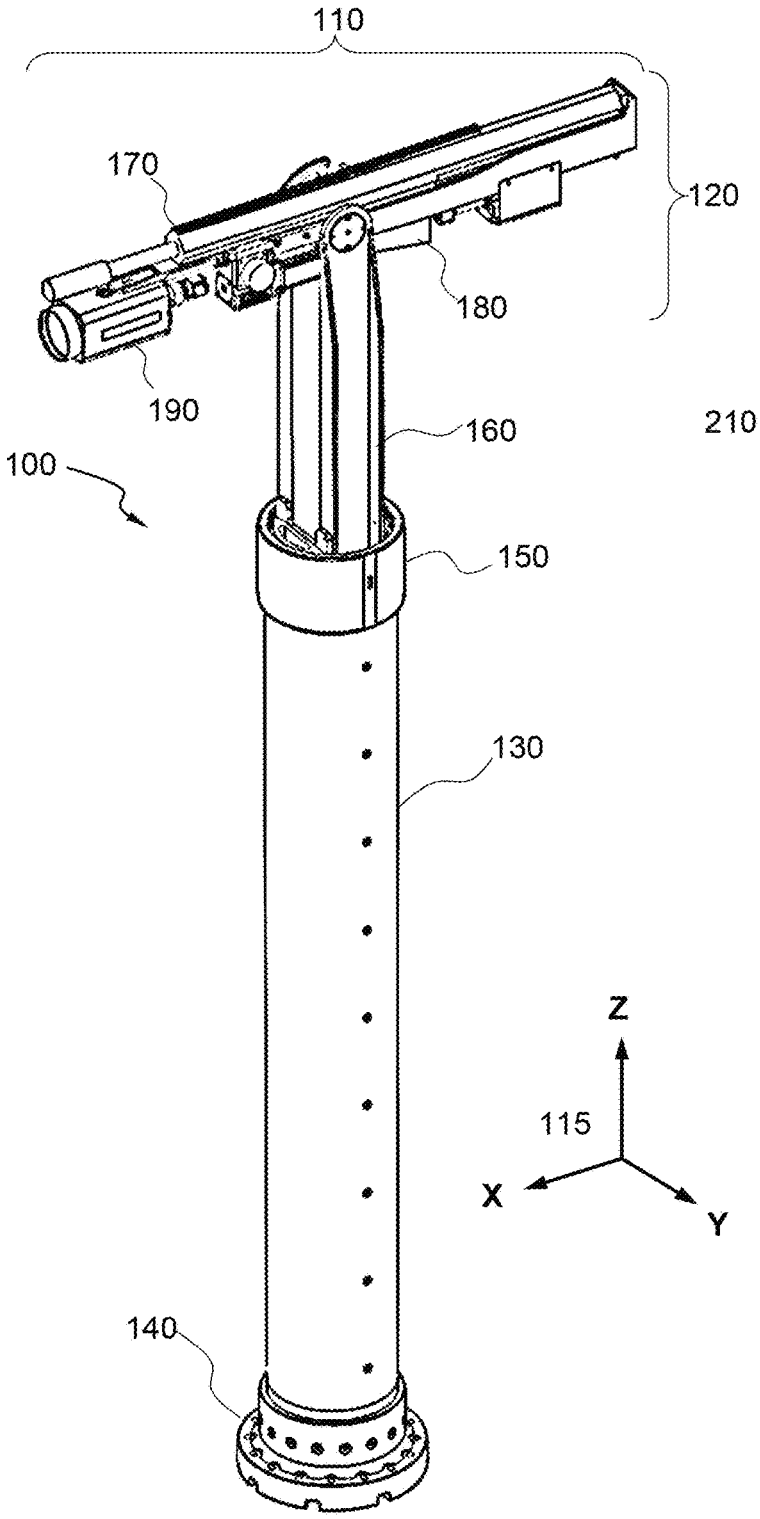
FIG. 1 is an isometric assembly view of an exemplary rifle lift and deployment mechanism.

FIG. 1 shows an isometric mount assembly view 100 of an exemplary rifle lift and deployment mechanism 110 displayed with a compass rose 115 of Cartesian coordinates X, Y and Z for reference. This mechanism 110 can be labeled a modular tube-stowed trainable sniper rifle mount. This mechanism 110 called a Trainable Gun Mount (TGM) includes a rifle assembly 120, a stowage tube 130, a flange 140, a collar 150 and a yoke assembly 160. In exemplary embodiments, the tube 130 is vertically oriented along its longitudinal axis, although this position while preferable is not limiting.

The rifle assembly 120 includes a .50 cal rifle 170, a cradle assembly 180 and an optics package 190. The exemplary tube 130 constitutes a cylindrical canister with 8.5" ID and a length of 72" for the illustrated configuration. The collar 150 serves to stiffen the tube 130, and a removable cover (not shown) over the collar 150 can protect the tube's interior from the environment. The flange 140 serves as a base for attachment to a floor, such as on a transport or lightly armed patrol vessel.

Upon command, the mechanism 110 can stow the rifle assembly 120 within the tube 130 to minimize environmental exposure, or else deploy the rifle assembly 120 for target engagement via line-of-sight aim. The tube 130 can be composed of an appropriate rigid material for the intended environment, such as steel, aluminum or carbon phenolic.

Figure 2:
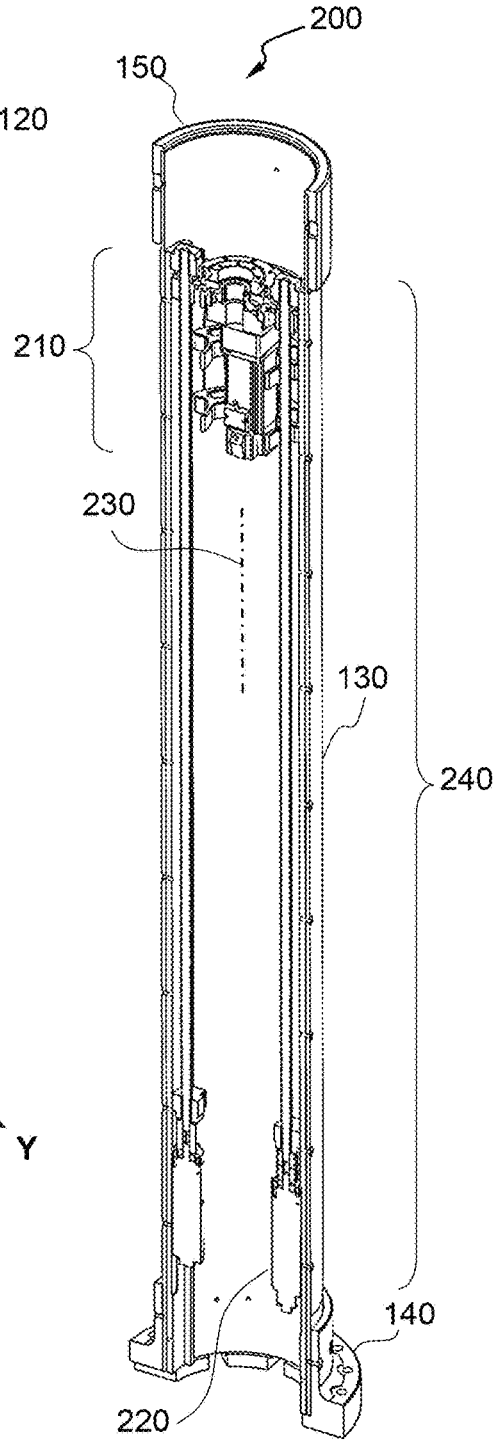
FIG. 2 is an isometric cutaway view of a rifle lift mechanism in a tube for stowage and mount.

FIG. 2 shows an isometric assembly cutaway view 200 of the tube 130 that contains a drive and control assembly hub 210 as an azimuth actuator, along with axial brushless servo motors 220. The azimuth hub 210 in conjunction with the servo motors 220, aligned along the tube's centerline 230 comprise a lift mechanism 240.

Figure 3:
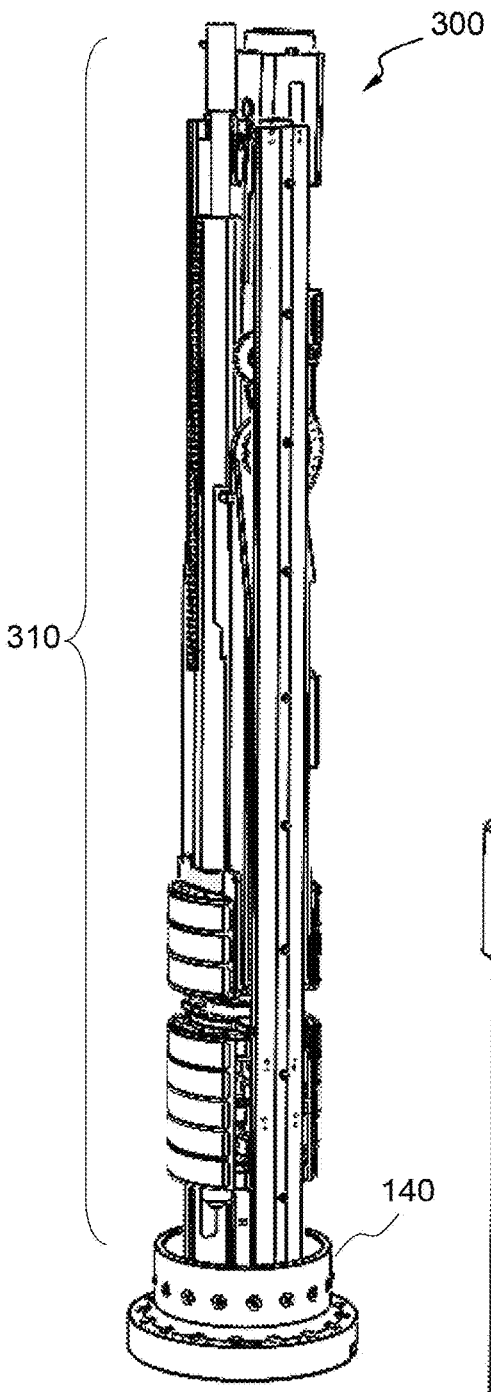
FIG. 3 is an isometric assembly view of a stowed rifle lift mechanism.

FIG. 3 shows an isometric assembly view 300 of the rifle assembly 120 and the yoke assembly 160 as a deployment package 310 stowed between the flange 140 and the collar 150. The lift mechanism 240 raises or lowers the package 310 out from or into the tube 130. The yoke assembly 160 serves to adjust elevation angle of the rifle 170 upon complete raising of the rifle assembly 120, while the azimuth hub 210 slews the package 310 to aim the rifle 170 towards the target.

Figure 4A:
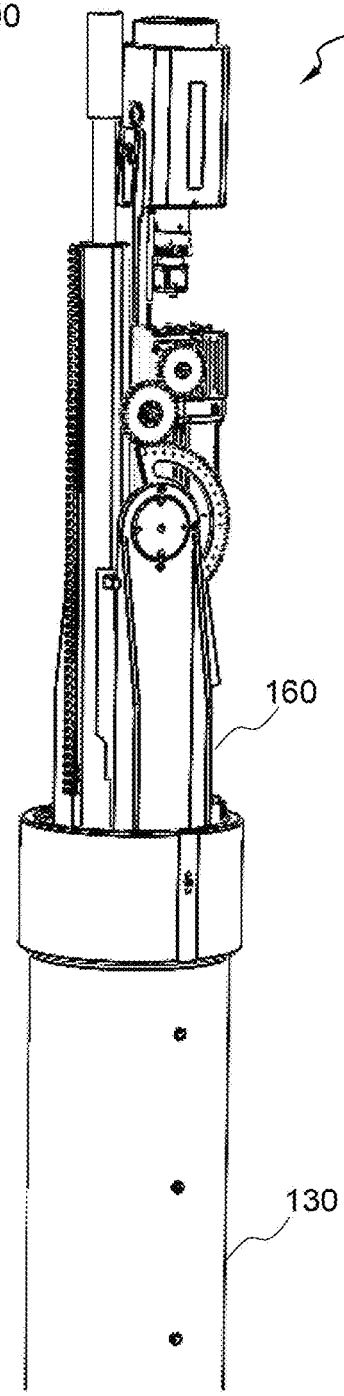
FIGS. 4A, 4B and 4C are isometric views of a the rifle lift mechanism being deployed.
Figure 4B:
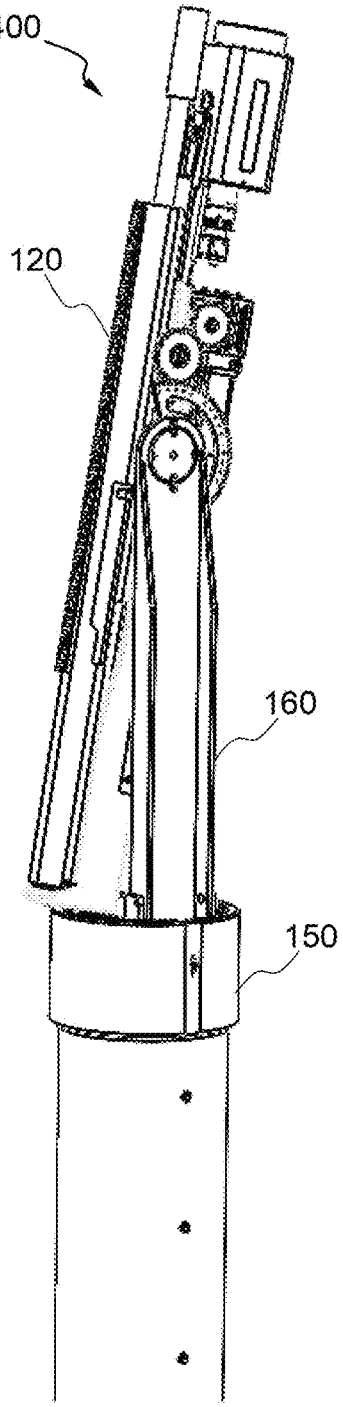
Figure 4C:
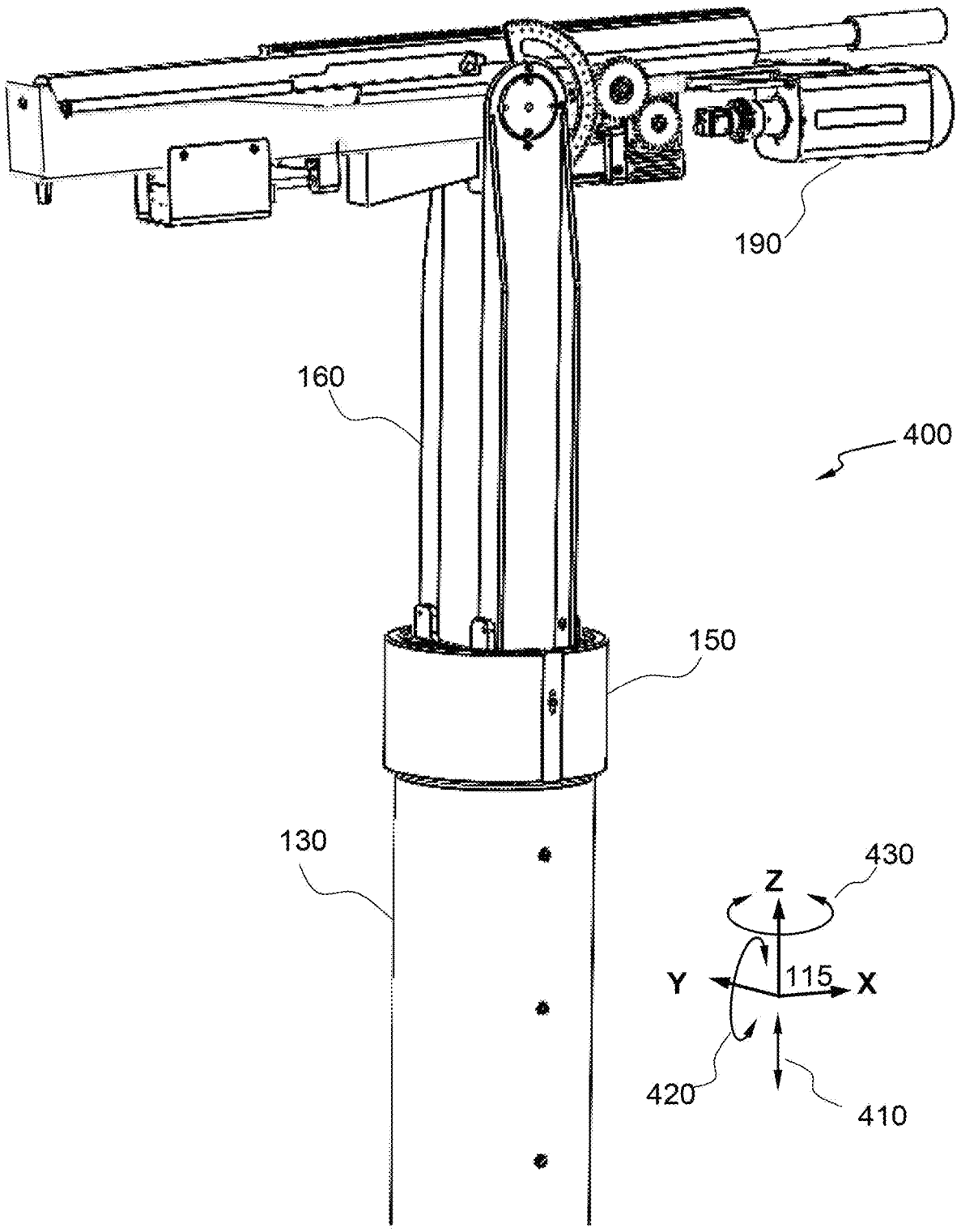

FIGS. 4A, 4B and 4C show isometric assembly views 400 of the rifle assembly 120 and yoke assembly 160 lifted above the collar 150 for deployment. FIG. 4A shows the yoke assembly 160 partly elevated from the tube 130. FIG. 4B shows the yoke assembly 160 fully raised from the tube 130 and the rifle assembly 120 partly tilted.

FIG. 4C shows the rifle assembly 120 pivoted from vertical to horizontal for deployment in relation to the compass rose 115 to aim at the target. Travel directions are shown as axial translation 410 along the Z axis and collinear to the tube's centerline 230, elevation rotation 420 to pitch about the lateral Y axis, and azimuth rotation 430 to slew about the Z axis. The hub 210 enables the deployment package 310 to translate axially 410 along the Z axis in the tube 130, while the yoke assembly 160 enables the rifle 170 to rotate laterally 430 about the Z axis, as well as in pitch 420 about the Y axis.

Figure 5:
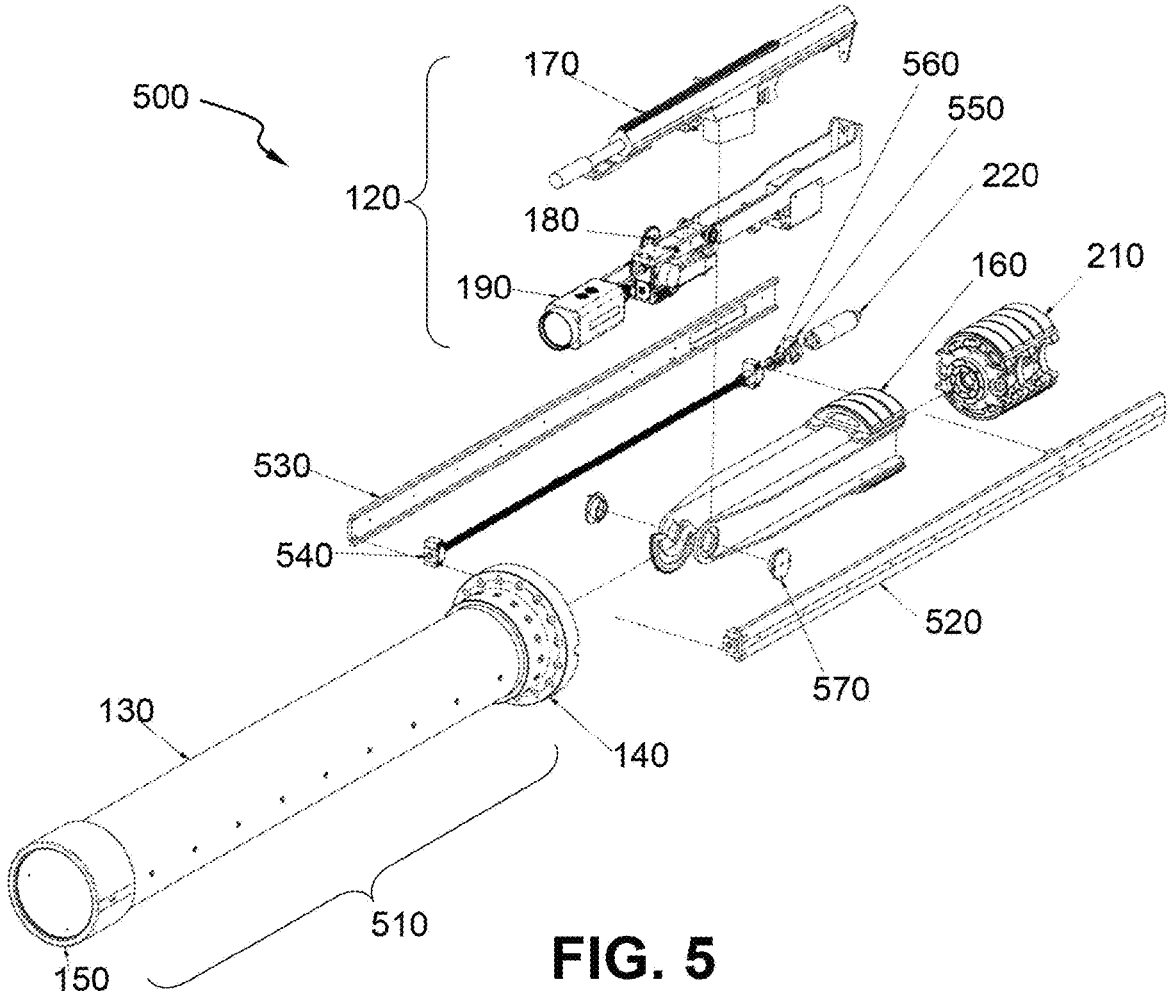
FIG. 5 is an isometric exploded view of the rifle lift components.

FIG. 5 shows an isometric exploded view 500 of components that comprise the mechanism 110. The tube 130, flange 140 and collar 150 constitute a cylindrical stowage canister 510. In addition to the yoke assembly 160 and the azimuth hub 210, the components further include the rifle assembly 120. A pair of tube rail assemblies 520 flanks the rifle assembly 120. Each rail assembly 520 includes a rail 530 and a ball screw assembly 540 that further attaches to a lift motor mount 550 and a shaft coupler 560 that connects to its axial servo motor 220. A pair of bearing caps 570 flanks the yoke assembly 160. The ball screws 540 coupled with their servo motors 220 provide an axial translation actuator.

Figure 6:
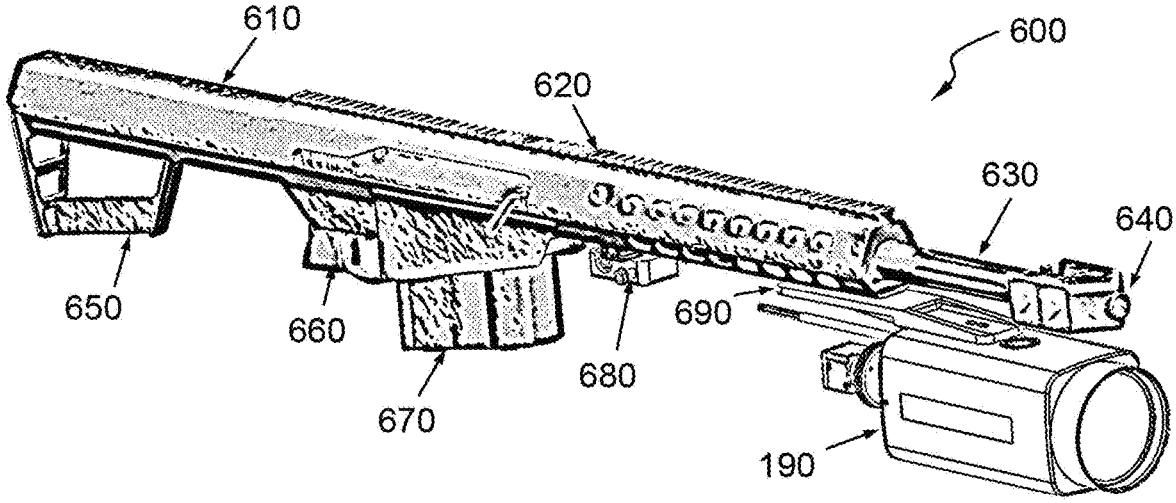
FIG. 6 is an isometric view of the rifle assembly.

FIG. 6 shows an isometric assembly view 600 of the rifle 170 and attendant components. A rifle stock 610 includes a picatinny rail 620 for attaching auxiliary components, such as an optical sight along a barrel 630 with a muzzle brake 640 at the firing end. The rifle assembly 120 further includes a stock brace 650, shortened hand grip 660, a magazine 670, a midlock pin adapter block 680 and a sight mount 690 for the optical package 190.

Figure 7A:
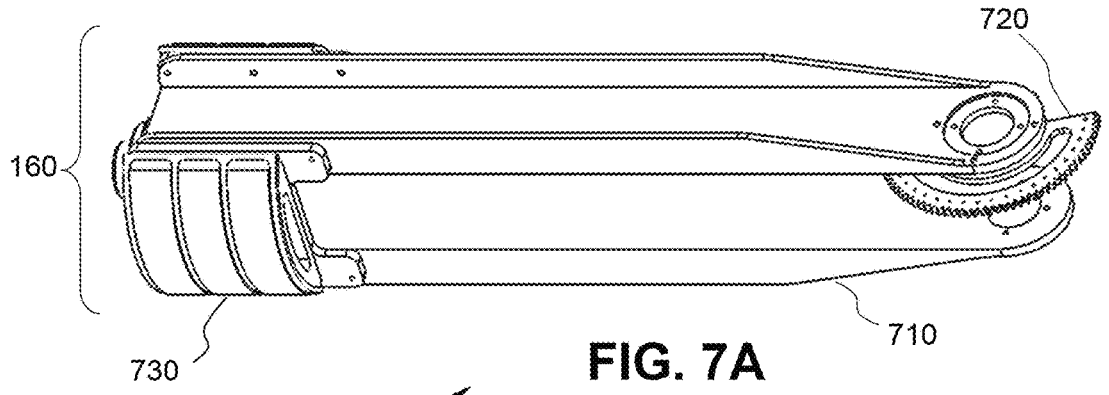
FIG. 7A is an isometric assembly view of a yoke mechanism.
Figure 7B:
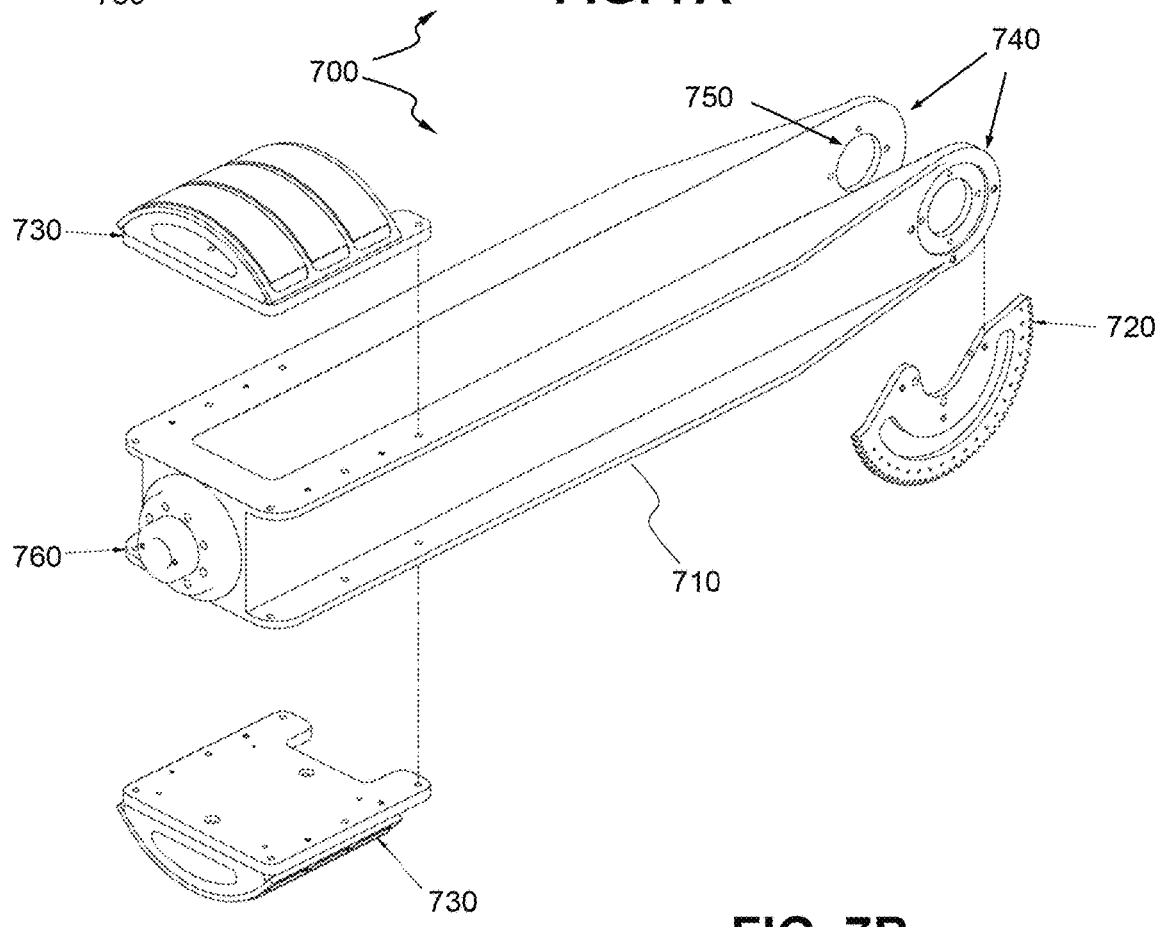
FIG. 7B is an isometric exploded isometric view of yoke components.
Figure 8:
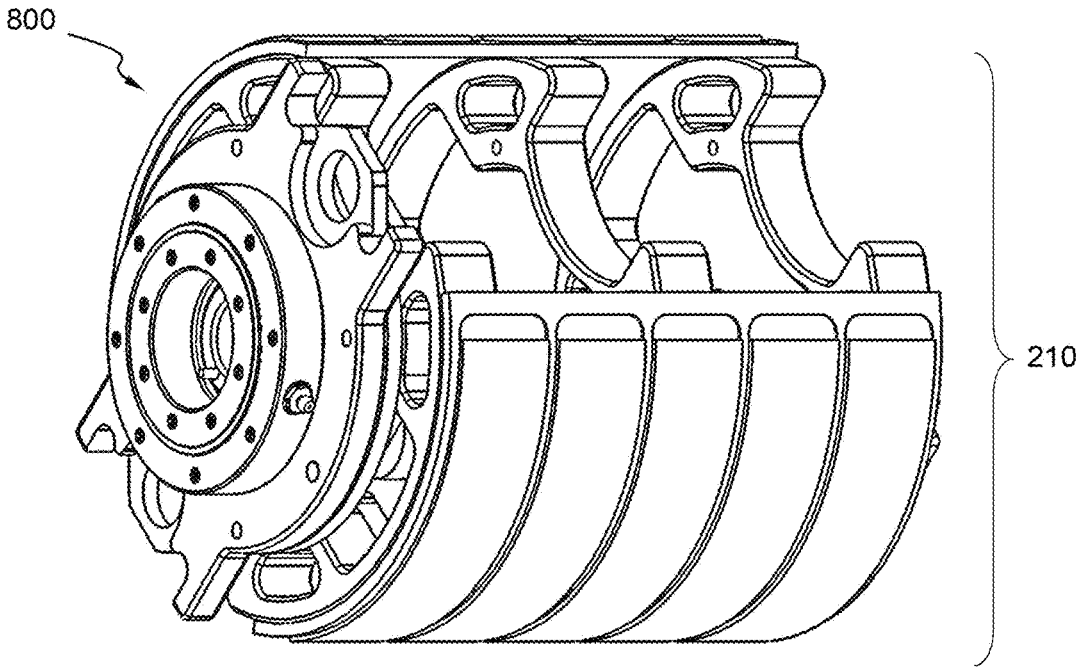
FIG. 8 is an isometric assembly view of an azimuth mechanism.

FIGS. 7A and 7B show respective isometric assembly and exploded views 700 of the yoke assembly 160, which includes a yoke 710, a spur gear 720 and an outrigger 730. The spur gear 720 enables calibration of the rifle's pitch elevation 420. The yoke 710 includes fork prongs 740, each with a hole 750 for coverage by the bearing caps 570. The spur gear 720 rigidly attaches to one of the prongs 740. The prongs 740 connect to a bridge 760. FIG. 8 shows an isometric assembly view 800 of the azimuth hub 210 that drives and controls direction of the rifle assembly 120.

Figure 9:
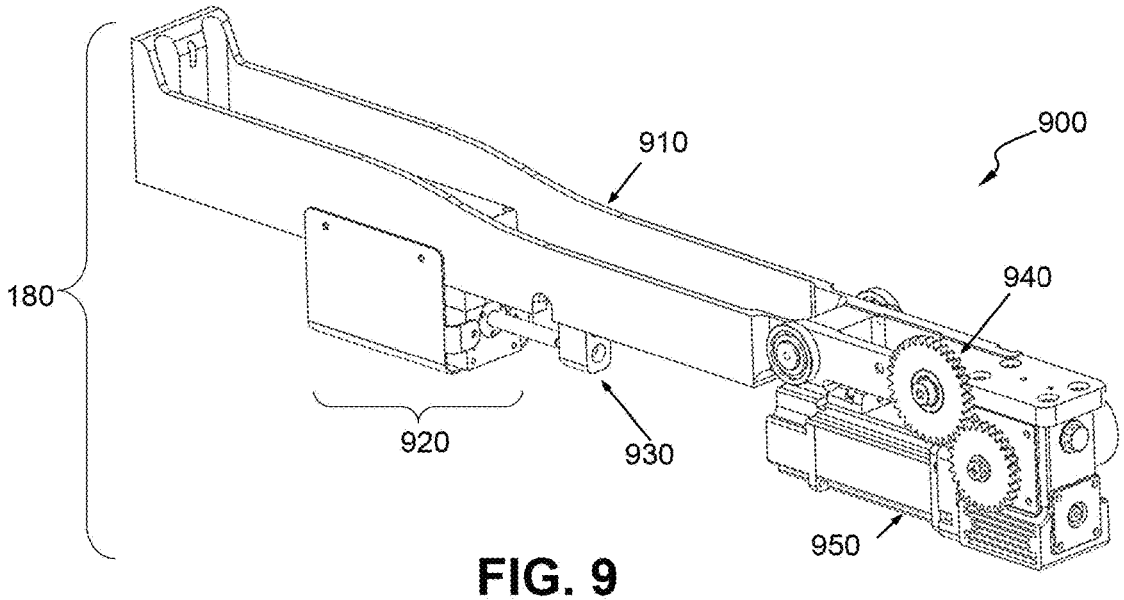
FIG. 9 is an isometric assembly view of a cradle for the rifle.

FIG. 9 shows an isometric assembly view 900 of the cradle assembly 180, including a cradle 910 for containing the rifle 170. An actuator bracket 920 engages a firing actuator or trigger 930 to fire the rifle 170 on command. The firing actuator 930 includes a steel block with a bolt extending laterally across. An idler gear 940 engages the spur gear 720 to pitch 420 the rifle assembly 120. An elevation drive 950 that engages an idler gear 940 completes these components. The elevation drive 950 as a pitch actuator enables the cradle 910 to pivot from parallel to the yoke 710 and its alignment to the tube's centerline 230 along the Z axis to a lateral orientation for engaging an adjacent line-of-sight target. The bracket 920 connects to a firing actuator 930 to fire the rifle 170.

Figure 10A:
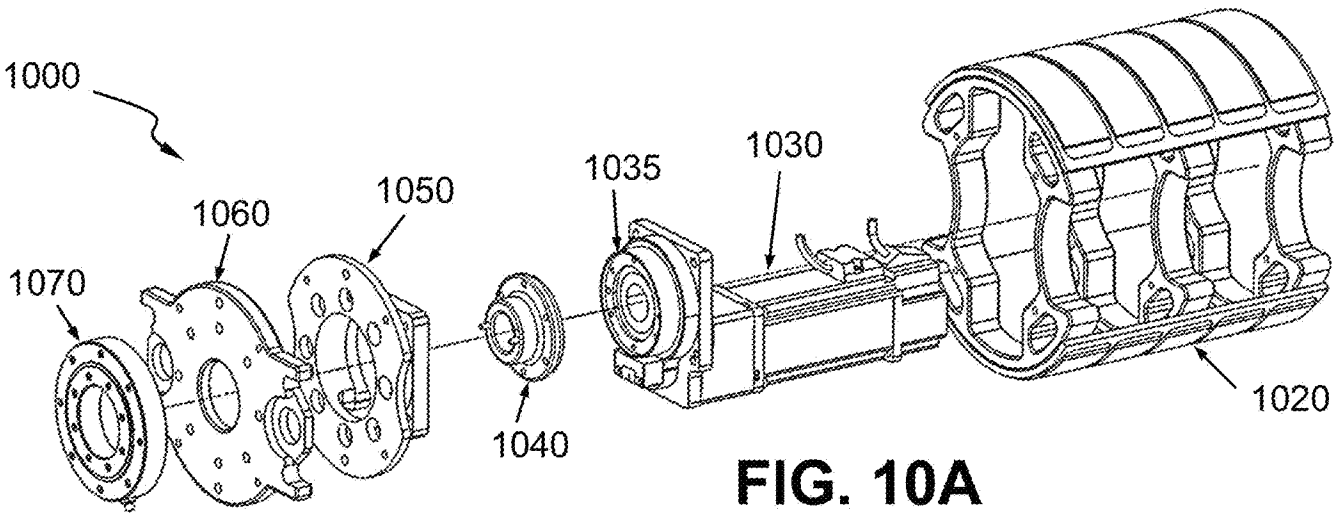
FIGS. 10A and 10B are isometric exploded views of components for the azimuth mechanism.
Figure 10B:
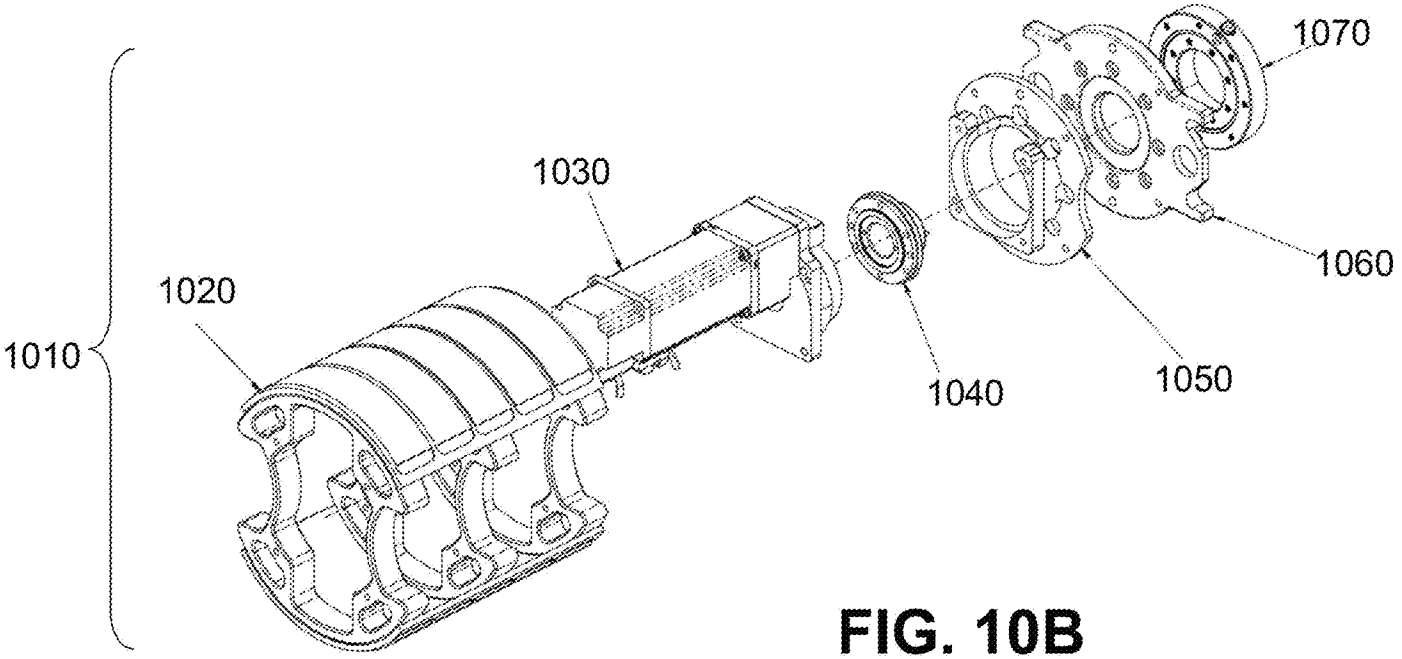

FIGS. 10A and 10B show isometric exploded views 1000 of components 1010 of the azimuth hub 210 shown in view 800. A piston weldment 1020 serves as a housing for an azimuth servo drive 1030 that connects to a turntable 1035, an azimuth coupler 1040, a motor mount 1050, a base plate 1060 and a slew bearing 1070.

Figure 11:
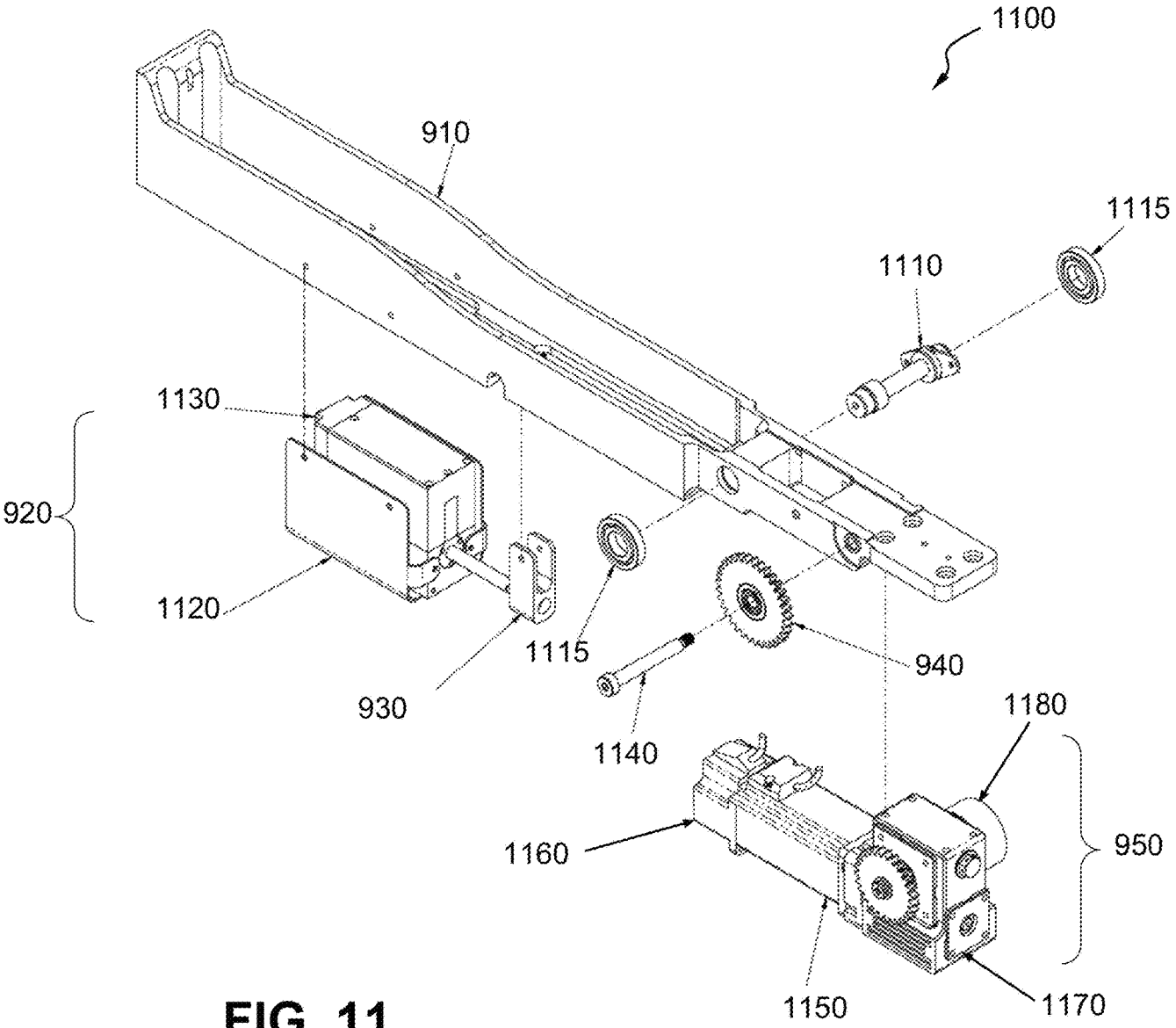
FIG. 11 is an isometric exploded view of components for the cradle.

FIG. 11 shows an isometric exploded view 1100 of components for the cradle assembly 180. A trunnion shaft 1110 passes through the cradle 910. A pair of Ø42 mm OD deep groove bearings 1115 flanks both ends of the shaft 1110. Each bearing 1115 includes a Ø20 mm bore. The bracket 920 includes an open box 1120 that contains a linear actuator 1130 for translating the actuator 930 to fire the rifle 170. An axle bolt 1140 attaches the idler gear 940 to the cradle 910. The elevation drive 950 includes a pitch pivot servo motor 1150 that attaches to the cradle 910. A power-off brake 1160 and an elevation drive gearbox 1170 attach to the pitch motor 1150 at opposite ends. An absolute encoder 1180 attaches to the gearbox 1170.

Figure 12:
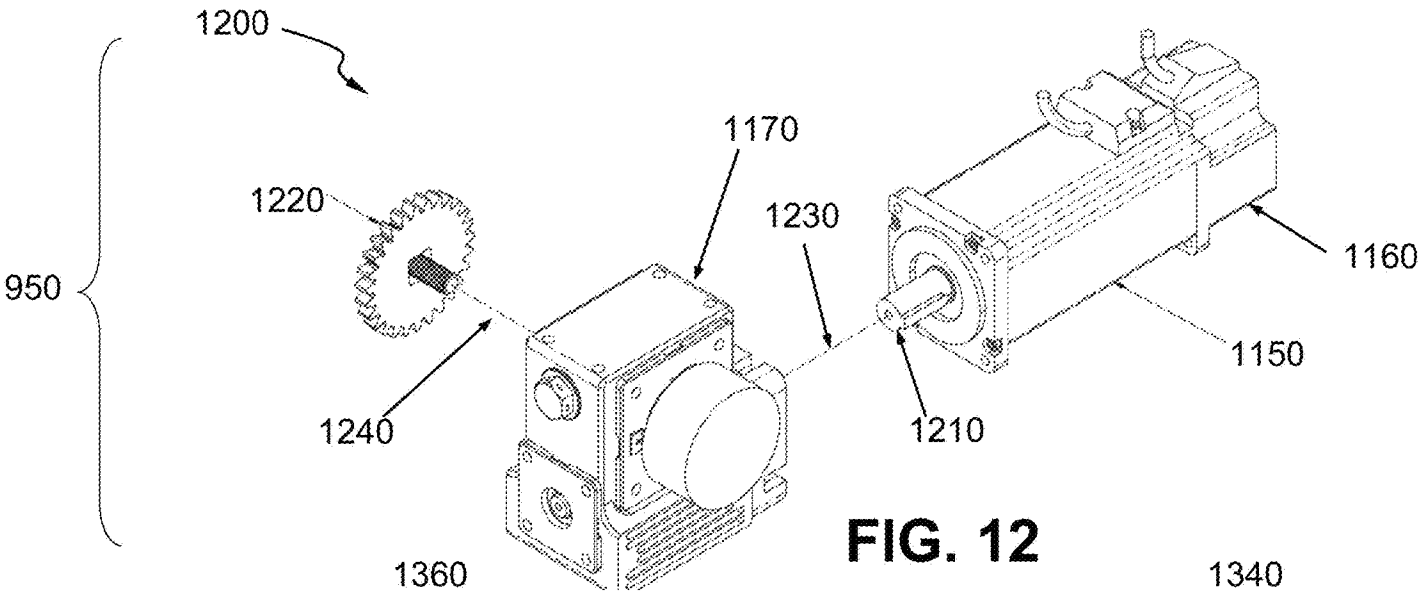
FIG. 12 is an isometric exploded view of components for a motor.

FIG. 12 shows an isometric exploded view 1200 of components for the elevation drive 950 and includes a drive shaft 1210 that transmits the torque from the pitch motor 1150 to the gearbox 1170. A pinion gear 1220 attaches to the gearbox 1170 opposite the absolute encoder 1180. The drive shaft 1210 turns on a drive axis 1230 approximately parallel to the cradle 910, while the pinion gear 1220 turns on an elevation axis 1240 perpendicular to the drive axis 1230.

Figure 13:
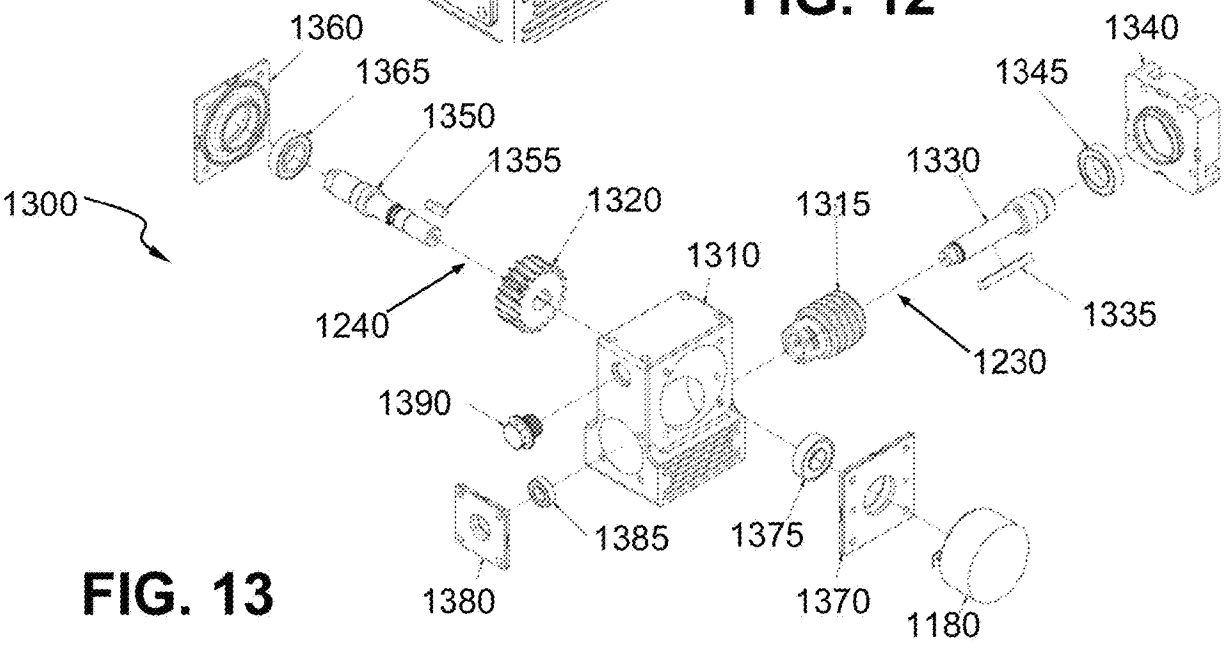
FIG. 13 is an isometric exploded view of components for a gearbox.

FIG. 13 shows an isometric exploded view 1300 of components for the gearbox 1170 contained within a gear housing 1310. Components for the gearbox 1170 include a wormscrew 1315, a wormgear 1320, an input shaft 1330 with its input key 1335 that connects to the drive shaft 1210, an input adapter 1340, a Ø32 mm OD bearing 1345, an output shaft 1350 with its output key 1355, an output cap 1360, a Ø30 mm OD bearing 1365, a lateral cap 1370, a Ø1.125" OD bearing 1375, an axial cap 1380, a Ø19 mm OD bearing 1385, a hex plug 1390 and the absolute encoder 1180.

The bearings 1345, 1365, 1375 and 1385 have corresponding bores of Ø20 mm, Ø17 mm, Ø0.5" and Ø10 mm. Such dimensions are appropriate for the .50 cal rifle 170 stowed within a 8.5" ID cylindrical envelope. Alternative dimensions could be appropriate for a weapon for a different size round.

Figure 14:
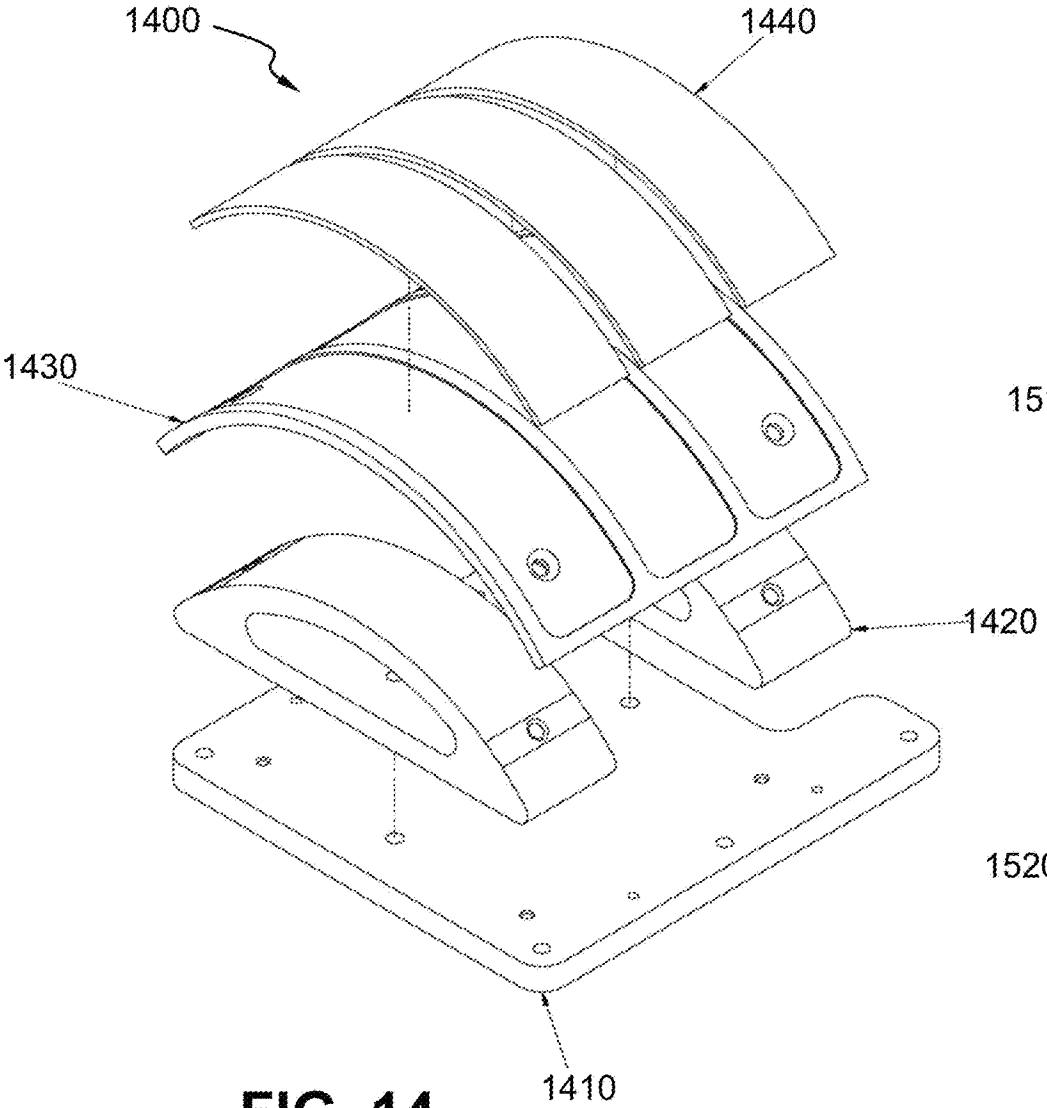
FIG. 14 is an isometric exploded view of components for an outrigger.

FIG. 14 shows an isometric exploded view 1400 of components for the outrigger 730. A yoke plate 1410 attaches to the yoke 710 and supports a pair of spacers 1420. An outrigger plate 1430 attaches by screws to the spacers 1420. Three wear strips 1460 are disposed to cover the plate 1430.

Figure 15:
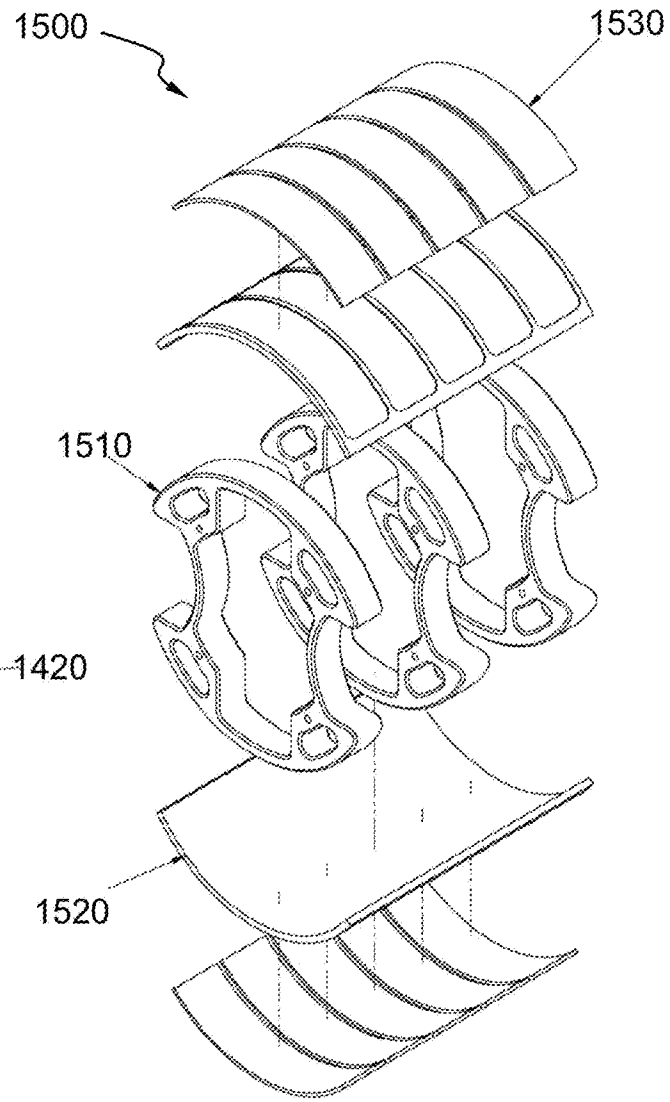
FIG. 15 is an isometric exploded view of components for an outrigger weldment.

FIG. 15 shows an isometric exploded view 1500 of components for the weldment 1020. A set of three piston supports 1510 are concatenated together. The supports 1510 have lateral gaps to enable the rail assemblies 520 to pass therethrough. A pair of piston plates 1520 flanks the supports 1510, which in turn are covered by a set of five wear strips 1530. The specific geometry and number of components are exemplary for the configuration being described, and thus not limiting.

Figure 16A:
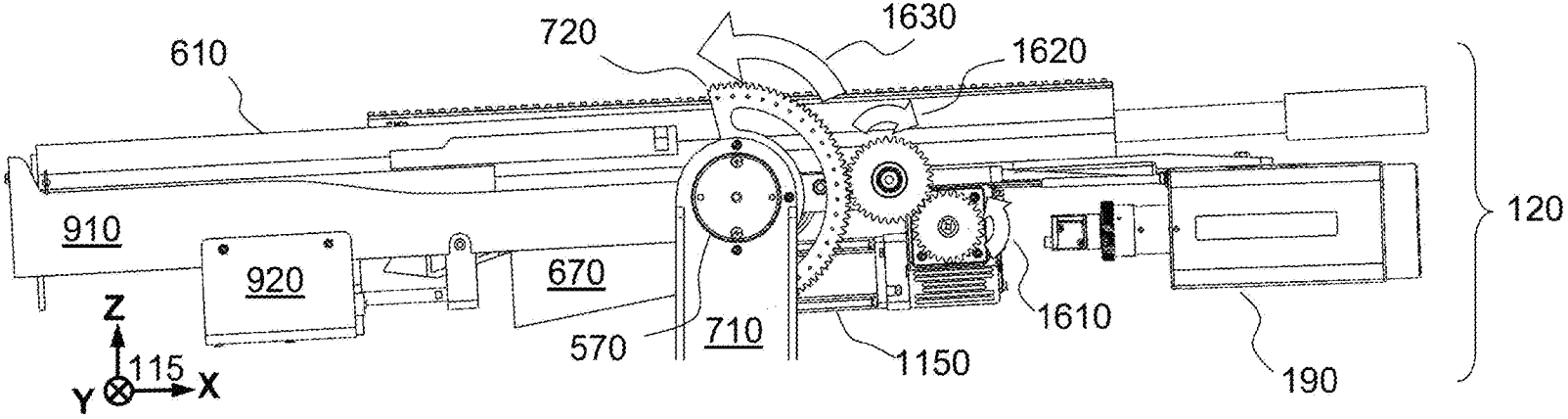
FIGS. 16A and 16B are isometric views of the rifle assembly.
Figure 16B:
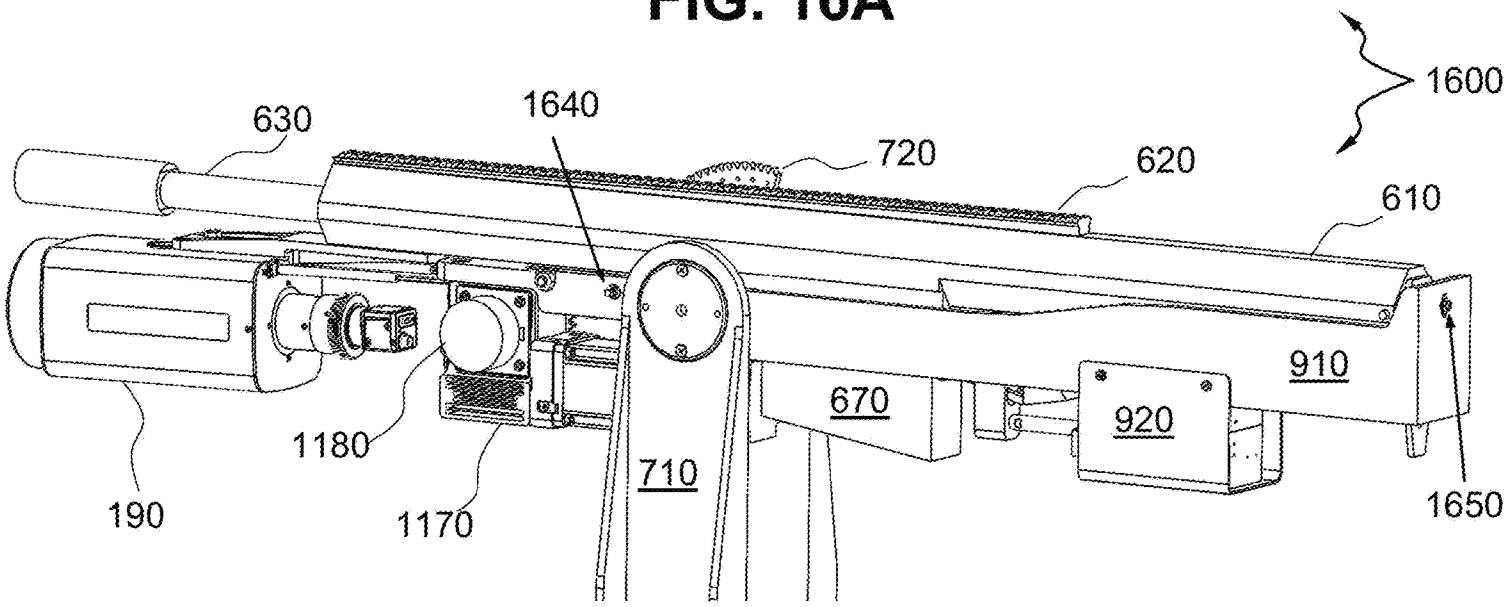

FIGS. 16A and 16B show respective elevation and isometric views 1600 of the rifle assembly 120 on the yoke assembly 160. The cradle 910 contains the stock 610 of the rifle 170 and pivots at the axis of the caps 570 on the yoke 710. The motor 1150 turns mechanisms in the gear box 1170 to rotate its pinion gear 1220 anti-clockwise 1610. The idler gear 940 rotates clockwise 1620 in response, which turns the spur gear 720 anti-clockwise 1630 for elevation rotation 420.

This turning operation 420 pitches the rifle assembly 120 in elevation from vertically aligned with the tube's centerline 230 to substantially horizontal for engagement. Upon termination, the operation reverses to enable the motor 1150 to turn the pinion gear 1220 clockwise, which turns the idler gear 940 anti-clockwise to rotate the spur gear 720 clockwise. This returns the rifle assembly 120 upright enabling its insertion into the tube 130 for stowage.

Figure 17A:
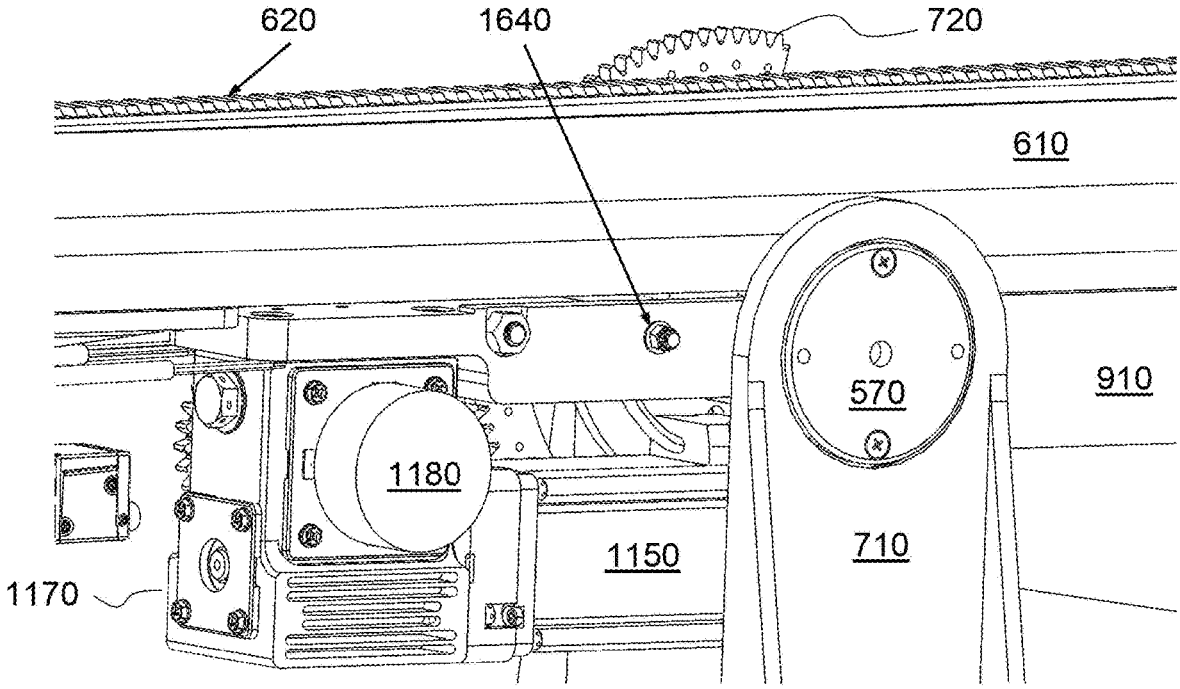
FIGS. 17A and 17B are isometric detail views of the rifle assembly.
Figure 17B:
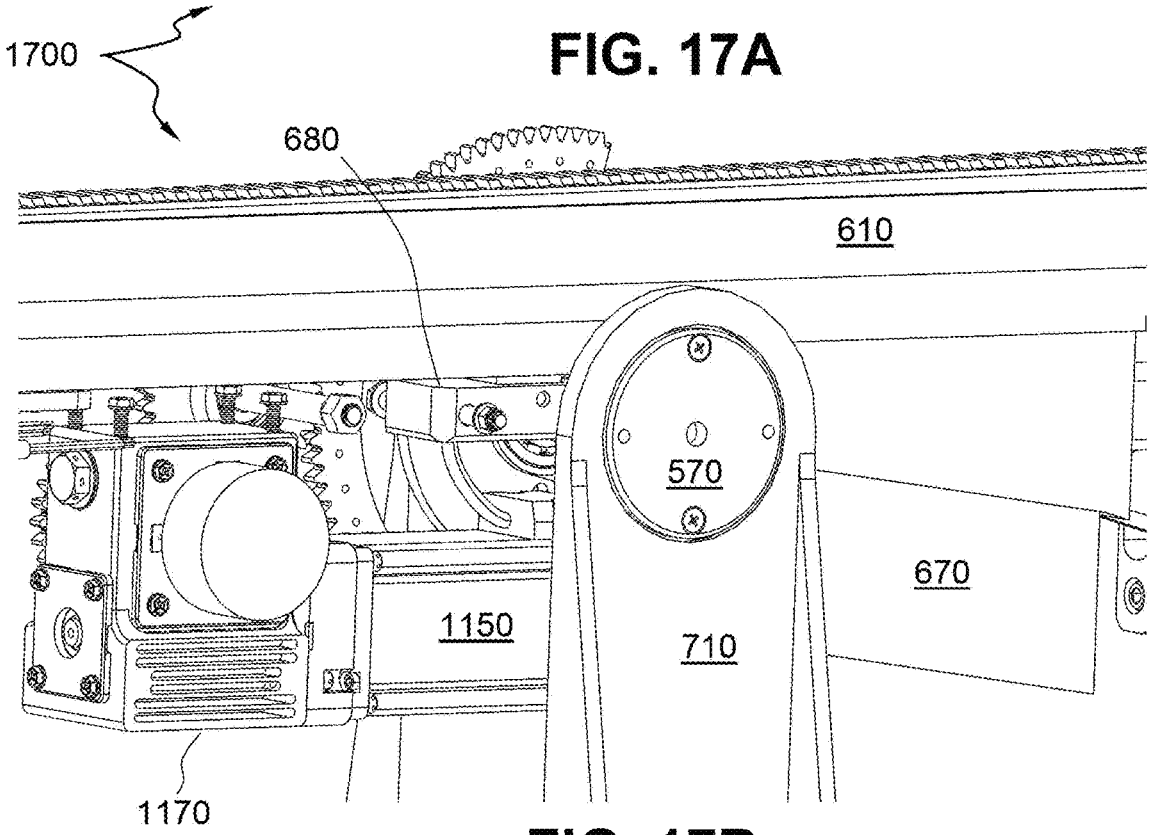

The rifle 170 attaches to the cradle 910 at two locations: midlock pin 1640 and rear attachment pin 1650. The primary location is the midlock pin 1640, which uses the adapter block 680 to offset the pin location to a more accessible location for installation of the rifle 170 into the cradle 910. The second rear attachment pin 1650 is located where the recoil butt pad would typically be located. The exemplary configuration removes the recoil pad and a screw as the pin 1650 inserts into the hole used in the cradle 910 to stabilize the rifle 170 rather than transferring load. FIGS. 17A and 17B show detail isometric views 1700 of the pivot drive 950 on the cradle 910, the latter of which is omitted in FIG. 17B to show the adapter block 680.

Figure 18:
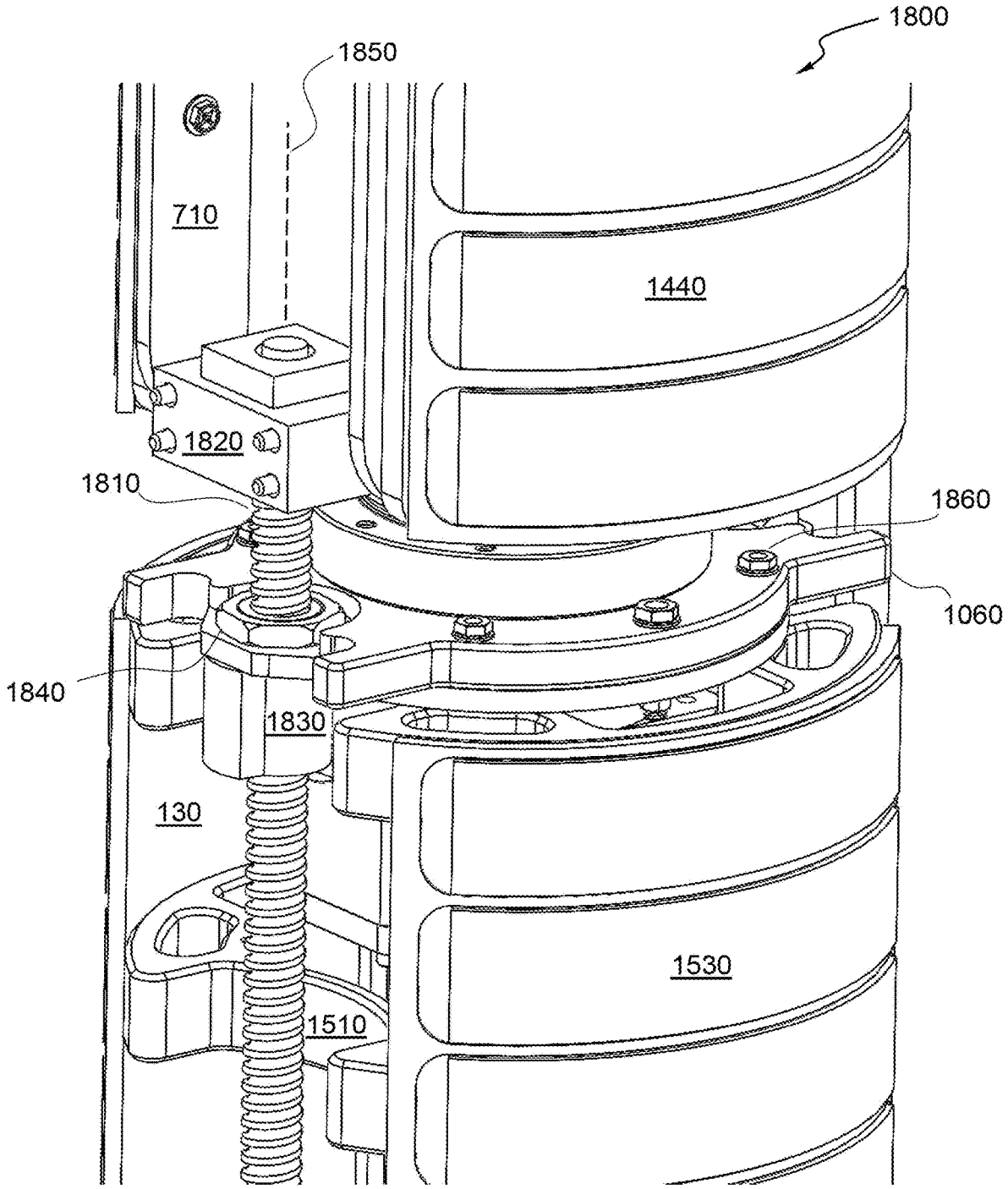
FIG. 18 is an isometric sectional view of the lift mechanism.

FIG. 18 shows a detail isometric view 1800 of components for the hub 210 and rail assembly 520 in the tube 130 with select supports 1510 omitted for clarity. The ball screw assembly 540 includes a threaded shaft ball screw 1810 together with a bearing block 1820, a ball screw nut 1830 and a jam nut 1840. A servo translation motor 220 turns the corresponding screw 1810 on its axis 1850, which translates the nut 1830 along that axis 1850. The base plate 1060 of the hub 210 engages the ball screw nut 1830 that slides along the rail 530. Screws 1860 fasten the base plate 1060 to the motor mount 1050. The pair of motors 220 operate together to raise the package 310 via the pair of ball screw assemblies 520.

The ball screw assemblies 520 constitute Thomson Linear mechanisms, each comprising a screw 1810, nut 1830 and bearing blocks 1820, with the screw 1820 driven by the servo motor 220. The base plate 1850 carries the yoke assembly 160 and azimuth bearing components connect to the ball screw 1810 by jamming between the ball screw nut 1830 and the jam nut 1840. As the ball screw 1810 spins as a spiral shaft, the ball screw nut 1830 translates, lifting the base plate 1060 along the rails 530 mounted to the tube 130. This translation follows the axis 1850 of the ball screw 1810 parallel to the tube's centerline 230.

Figure 19A:
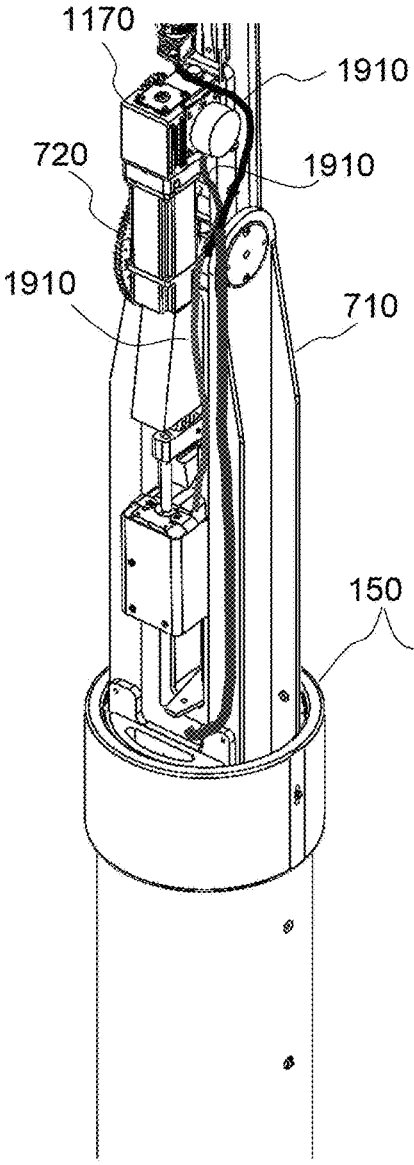
FIGS. 19A, 19B, 19C and 19D are isometric views of cable conduits within the lift mechanism.

FIGS. 19A, 19B, 19C and 19D show detail isometric views 1900 of elevation and azimuth components stowed within the tube 130, together with various electrical cables 1910 arranged therein. FIG. 19A illustrates the rifle assembly 120 partially raised from the tube 130 with the cables 1910 displayed within the yoke 710 and the cradle 910.

Figure 19B:
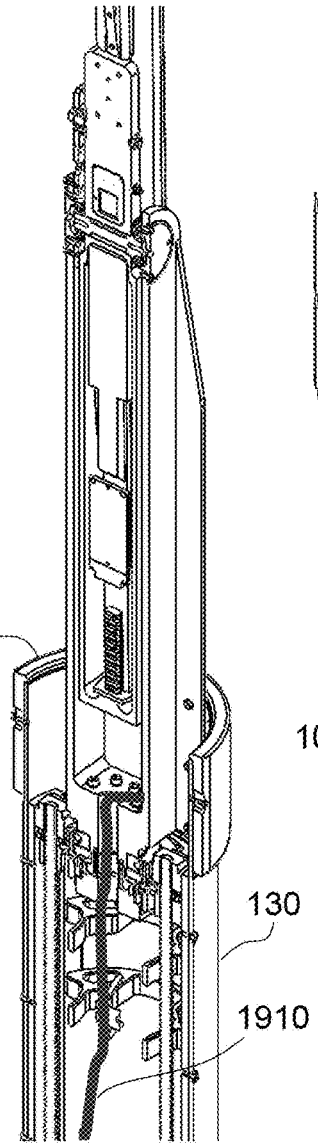
Figure 19C:
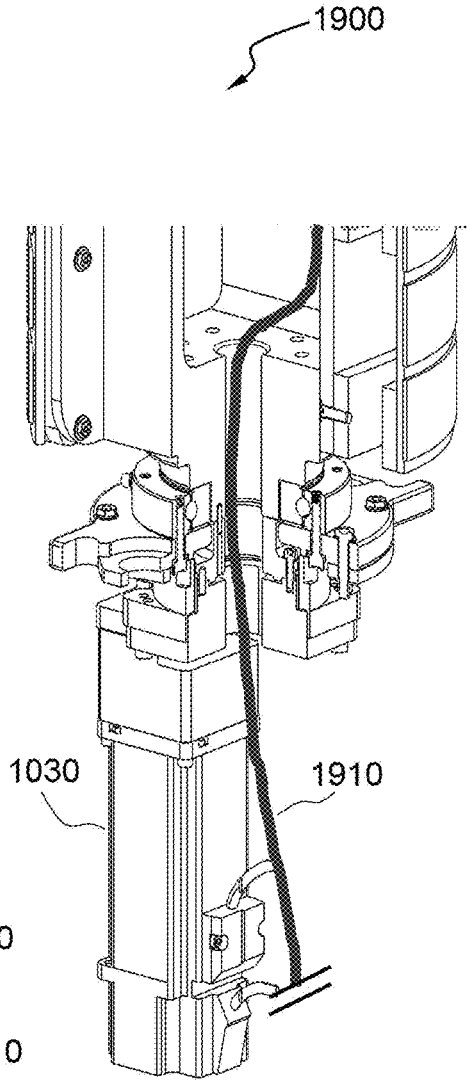
Figure 19D:
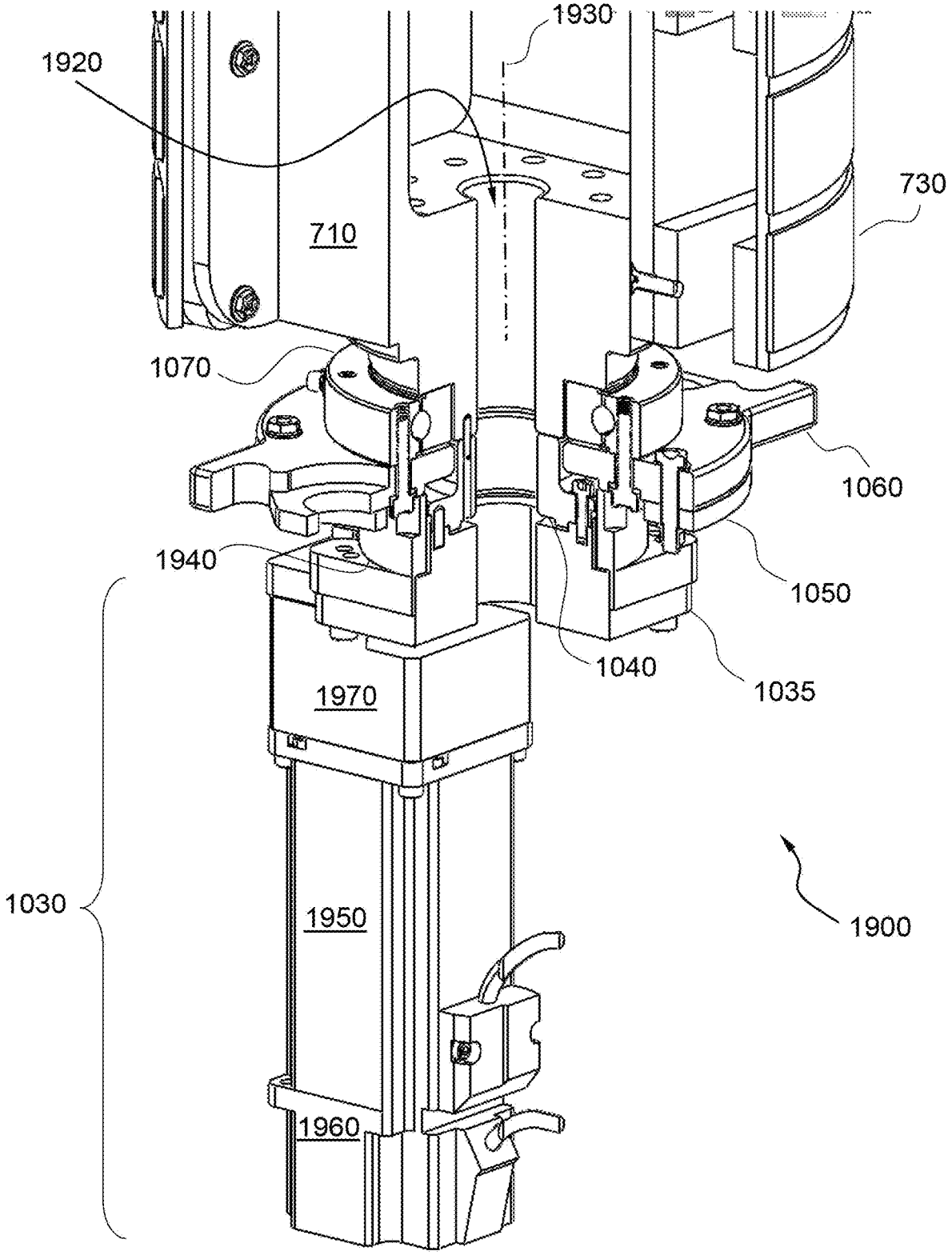

FIG. 19B illustrates a cutaway view with one cable 1910 through the hub 210 and tube 130 and into the yoke 710. FIG. 19C presents a detail cutaway perspective illustrating one cable 1910. FIG. 19D presents an enhanced view of FIG. 19C absent the cable 1910 and identifying an axial conduit 1920 in the yoke 710, base plate 1060 and slew bearing 1070 along a vertical axis 1930 parallel to the tube's centerline 230.

Elevation control is powered by motor assembly 950 that includes the brushless motor 1150 and brake 1160, equipped with a custom gearbox 1170 with absolute encoder 1180. Azimuth control is powered by servo drive 1030 that includes a brushless motor 1950 and brake 1960, equipped with a commercial gearbox 1970. The gearbox 1970 attaches to the slew bearing 1070 that connects to the coupler 1040 sandwiched radially inside the mount 1050 and axially between the yoke 710 and the turntable 1035. The turntable 1035 offsets the motor 1950 off-center and continues the axial conduit 1920 for cables 1910 to run through the center of the yoke 710, base plate 1060 and turntable 1035, which includes an outer ring 1940 to support the base plate 1060.

The absolute encoder 1180 provides feedback to the fire control software to position the mount 1050 during target acquisition and engagement. The motor 1150 has an integrated power-off brake 1160 to hold the adapter block 680 in position during power loss and firing events. The drive coupler 1040 transfers the torque from the turntable 1035 to the yoke 710. The mount 1050 rotates about the slew bearing 1070 that handles movement loads along with the outriggers 730.

The hub 210 for the lift mechanism 240 is powered by a pair of motor driven ball screw assemblies 540. Each assembly is a stock Thomson Linear actuator comprising a screw 1810, bearing blocks 1820 and nuts 1830, 1840. The screw 1810 is driven by a motor 220. The base plate 1060 that carries the azimuth bearing and yoke components attaches to the ball screw 1810 by jamming between the ball screw nut 1830 and a jam nut 1840. As the screw 1810 spins, the ball screw nut 1830 translates along its corresponding rail 530, lifting the base plate 1060. Note that the tube 130 and rails 530 are omitted for clarity.

Electrical cables 1910 are routed within the tube 130 and through a pass-through conduit 1920 in the yoke 710, coupler 1040, and azimuth drive turntable 1035. Azimuth control is powered by a brushless pitch motor 1150, which is equipped with a commercial gearbox 1170 and absolute encoder 1180. The turntable 1035 offsets the motor 1950 off center and continues pass-through conduit 1920 for cables 1910 to run through the center of the mount 1050.

The absolute encoder 1180 provides feedback to fire control software to position the mount 1050 during target acquisition and engagement. The motor 1150 also has an integrated power-off brake 1160 to hold the mount 1050 in place during power loss and firing events. The drive coupler 1040 transfers the torque from the turntable 1035 to the yoke 710. The mount 1050 rotates about the slew bearing 1070, which handles moment loads along with the outriggers 730 and weldment 1020.

Pitch of the rifle 170 is controlled by the pitch motor 1150 and its gear train in the gear box 1170. The motor 1150 drives a face-mounted wormgear 1320 with an external pinion gear 1220, which drives an idler gear 940 that then "walks" around the stationary spur gear 720 fixed to the yoke 710. Because this spur gear 720 is fixed, this forces the cradle 910 to move about the trunnion axis 1240.

The rifle 170 is attached at two locations. The primary location is the midlock pin 1640 as a designed load transfer point of the rifle 170. The midlock pin 1640 uses an adapter to offset the pin location to a more accessible location for installation into the cradle 910. The second attachment location 1650 is at the rear of the rifle 170 where the recoil butt pad would normally be located. The rifle's standard recoil pad is removed, and a screw at location 1650 fastens to the same hole used in the cradle 910. This location 1650 serves to stabilize the rifle 170 rather than transferring load.

For comparison, the azimuth and elevation drive assemblies 950 and 1030 are similar in size and operation. Thus, the brushless servo motors 1150 and 1950 are comparable, as are the brakes 1160 and 1960. These 24 Vpc motors 1150 and 1960 are supplied by Orbex Group of Austin, Texas as respective models HPM60-03-48-01-B and HPM60-02-36-01-B with rated power of 0.53 KW.

Figure 20:
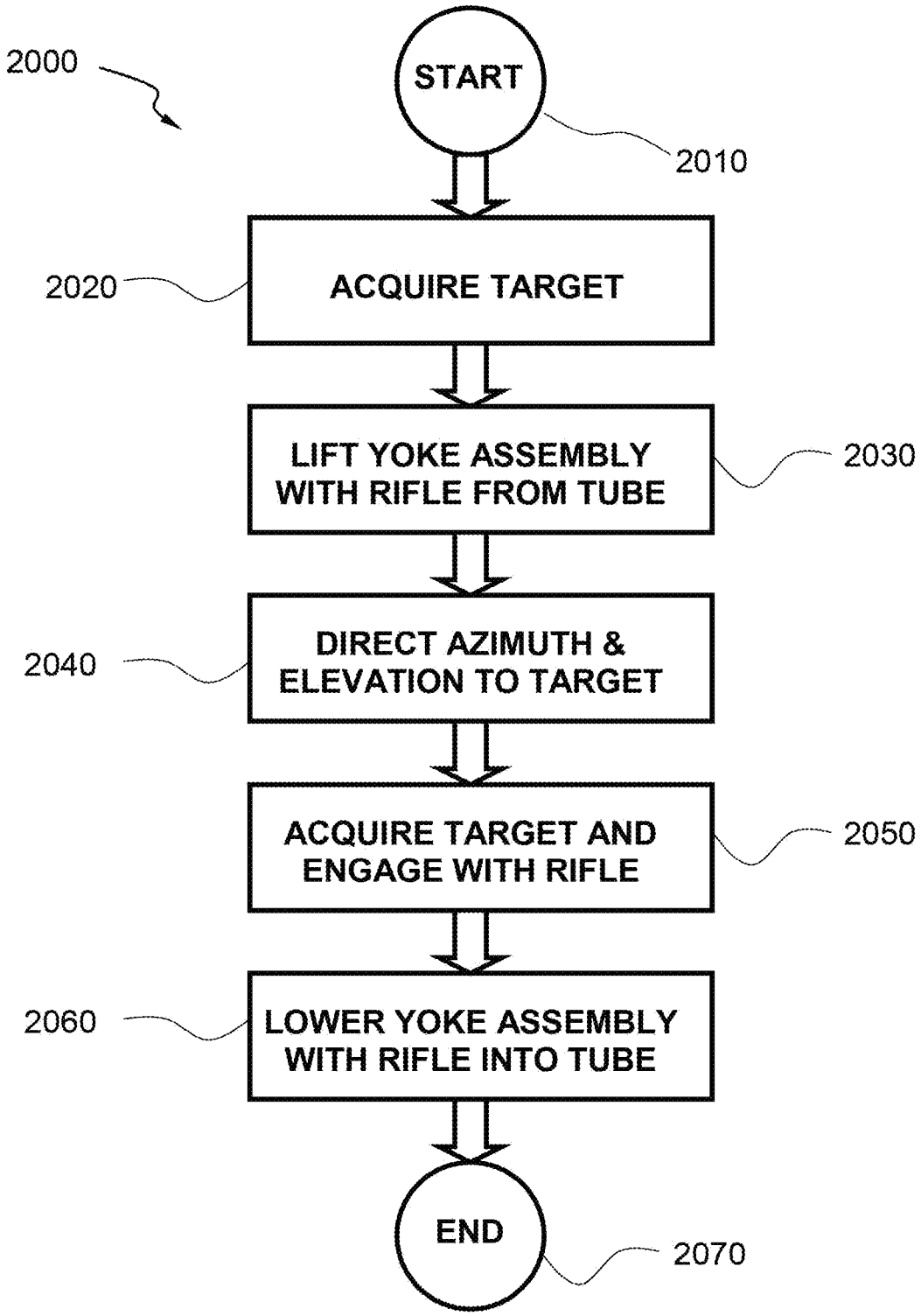
FIG. 20 is a flowchart view of an operational sequence for target engagement and stowage return.

FIG. 20 is a flowchart view 2000 of an operational sequence for the mechanism 110. At start 2010, a control system acquires 2020 a target. Upon command, the yoke assembly 160 lifts 2030 from the tube 130 with the rifle 170. The azimuth controller 210 directs 2040 the rifle 170 to aim at the target. The controller acquires the target and engages 2050 the rifle 170. The yoke assembly 160 lowers 2060 the rifle 170 into the tube 130, terminating 2070 the operation.

The modular tube-stowed trainable sniper rifle mount as an exemplary mechanism 110 is a vertically stowed Trainable Gun Mount (TGM) for use with a .50 caliber rifle 170. The mechanism's package 310 is designed specifically to fit inside a missile launch tube 130 that is 8.5" ID and 72" long. Such missile canisters can be used on a variety of platforms and enable additional functions and capabilities to systems that typically could only carry missiles. This mechanism 110 has been designed to effectively engage targets up to 1600 m distant.

While conventional TGMs designed for use with the .50 cal rifle 170 selected (e.g., M82A1, M107, M107A1) exist, none of them enables the rifle 170 and remainder of a deployment package 310 to be stowed vertically inside a tube 130, lift out, and train to engage. Being able to vertically stow the package 310 reduces considerably the footprint needed and enables this reversibly modified rifle 170 to be deployed in a vast array of subsystems.

The primary focus for this design is to be able to replace a standard missile launch canister with the exemplary mechanism 110 as a TGM, which enables operation of a remote operated system that is cheaper to operate, easier to maintain, and discrete to engage compared to conventional missiles of similar size. Another advantage this mechanism 110 has over other TGMs is retention of a small profile and remote operated capability (such as missiles) that enables operation on small, stealthy, remote operated platforms where commercial gun mounts would falter.

The exemplary modular tube-stowed trainable sniper rifle mount as the mechanism 110 constitutes a TGM designed to be able to vertically stow inside a standard missile tube and engage targets after lifting out. Live fire testing was performed to capture relevant recoil data to appropriately design and analyze components to ensure safety and lifecycle of the system. The .50 cal Browning Machine Gun (BMG) round (diameters: bullet Ø0.510", rim Ø0.804") is primarily used for anti-materiél in heavy machine guns, but also is used for long range anti-personnel in purpose-built sniper rifles. This high kinetic energy delivery in combination with accuracy and long range presents this configuration as a prime candidate for such purposes.

The tube 130 is a standard Ø8.5" ID annular cylinder that houses all of the components of the system. The only components directly attached to the tube 130 are the lifting devices. This includes a pair of ball screws 540 driven by the translation lift motors 220. The elevation servo motor 1150 includes an absolute controller 1180 to set position and command the azimuth servo motor 1950, which has an electric brake 1960 to hold the system in place. The ball screws 540 connect to the azimuth hub 210 via a ball screw nut 1830. The ball screws 540 and servo motors 220 attach to a set of rails 530 that bolt to the interior wall of the tube 130. By releasing such fasteners and freeing these rails assemblies 520, so the entire mechanism 110 can be removed as a whole, thereby being independent of the tube 130 as its container.

The azimuth hub 210 is responsible for rotating the rifle assembly 120, and is the connecting point to the lift controls via the baseplate 1060. This controller 210 also contains a set of outriggers 730 to transfer the recoil impulse into the tube 130. This hub assembly 210 contains the azimuth drive motor 1030, control coupler 1040, base plate 1060, slew bearing 1070, and outriggers as plates 1520 and strips 1530 on the weldment 1020.

The yoke assembly 180 provides the connection between azimuth and elevation motions. This component provides the primary load transfer as an unsupported cantilever between the tube's foundation and gunfire reaction. The primary component for the yoke assembly 180 is the yoke 710, fashioned from an aluminum block.

The bottom of the yoke 710 mates to the azimuth coupler 1040 while the top of the yoke 710 connects to the trunnion shaft 1110 on the cradle 910. Other components in the yoke assembly 180 include a pair of additional outriggers 730 to support recoil loads from the rifle 170, and the elevation drive 1030. This spur gear 720 bolts to the yoke 710 upright to remain stationary while the gearbox 1170 from the translation motors 220 ride along the circumference of the spur gear 720 to raise or lower the rifle 170 in pitch 420.

The cradle 910 holds the rifle 170 and initial recoil loads from gunfire. The cradle 910 provides the primary elevation control. Elevation motion 420 is performed by the pitch motor 1150 that drives an external gearbox 1170 connected to the pinion gear 1220 that rotates the idler gear 940 to align the spur gear 720. As that motor 1150 drives this gear box 1170, the cradle 910 walks around the trunnion shaft 1110 and bearings 1115 until trained to the desired target location. The actuator bracket 920 attaches to the rear of the cradle 910 to remotely pull the actuator 930 for firing the rifle 170 on command.

The rifle 170 constitutes the final component of the mechanism 110. The rifle 170 used is a military issued M107/M107A1 with 20" barrel 630. Changes required to the rifle 170 include a shortened handgrip 650, shortened magazine 670, and use of the bipod attachment holes for the optics package 190. The height of an unmodified rifle absent the shorter grip 650 and magazine 670 cannot fit inside the tube 130, but these are easily exchangeable parts.

Because this configuration omits a bipod, the mounting holes are used to support the optics package 190 instead. This ensures the optics are always tied directly to the rifle 170 for proper pointing. This provides additional safety to ensure the operator observes any object in front of the weapon through the optics package 190 at all times. The actuator bracket 920 holds the firing actuator 930 in position. The firing actuator 930 pulls the trigger of the rifle 170 when commanded. This bracket 680 bolts to the cradle 910 and denotes the primary load path for recoil of the mechanism 110 through the midlock pin 1640 and adapter block 680. A screw at the rear pin 1650 of the rifle 170 attaches to the rear of the cradle 910 for maintaining positive control and direction and reduce lateral jostling.

This exemplary mechanism 110 has integrated remote operated capabilities including self-supported optics, firing, elevation, azimuth, and lift controls as part of the TGM. A standard military issued M107/M107A1 rifle can be adapted with minor and reversible alterations to the rifle 170. Due to its design to stow in the tube 130, the rifle 170 can be deployed on systems that a typical gun mount cannot. The tube 130 also provides discretion and protection of the system for deployment in an open environment, so as to only be exposed when ready to engage threats.

The elevation drive gearbox 1170 is a custom designed worm-gear speed reducer specifically tailored to fit in the limited space-claim available of the tube 130 while still enabling the demanding output torque and load case required of the package 310. The design of the gearbox 1170 with wormscrew 1315 and wormgear 1320 enables for a high gear reduction, perpendicular output relative to the pitch motor 1150, and redundant self-locking capability along with the motor's electronic-brake 1160.

The gearbox 1170 also has dual output shaft 1350 and bearing 1375 to enable an absolute encoder 1180 to be installed. This encoder 1180 increases reliability and tracking of the system. No commercial gearbox was identified that could perform the requirements needed for this configuration in the size, weight, and output.

The azimuth hub 210 utilizes a speed-reducing turntable 1070 that serves multiple purposes. The turntable 1070 offsets the motor 1950 parallel to the tube's centerline 230 and facilitates passage through the central cavity 1920 of the package 310. This pass-through capability permits access for cables 1910 from systems on the cradle 180 and rifle 170 to run to a central cable bundle to the bottom of the tube 130, thereby simplifying cable routing. The built-in reducer gearbox 1170 enables the pitch motor 1150 to reach proper torque without needing an additional bolt-on gearhead, thereby decreasing backlash in the system. The gearbox 1170 also includes an absolute encoder 1180 to increase reliability and tracking. Because this ball screw 540 is concentric to the tube 130, it also enables the package 310 to have full 360° turn coverage 430 in azimuth.

Recoil Loads are a major consideration with the exemplary mechanism 110. When engaged the rifle 170 is ~30" above the adapter block 680, creating a large moment load into the slew bearing 1070. In order to have a bearing that would fit inside the tube 130 without damage, outriggers 730 were developed to distribute the load. The outriggers 730 that attach to the yoke 710 and plates 1520 on the azimuth hub 210 are lined with low-friction, dry-running (self-lubricating) wear strips 1430 and 1530 that enable the package 310 to lift 410 and spin 430 while maintaining contact with the wall of the tube 130. Recoil loads are then transferred over a larger surface area and into the structure of the tube 130, minimizing the bearing sizes required.

The engineering team performed an analysis of alternatives and found other .50 cal sniper rifle gun mounts, but none that satisfied the requirements of stowage inside a tube 130. Commercial motors were compared to find suitable solutions to satisfy drive requirements, electrical requirements, and availability. There are currently no existing alternate designs that can perform the requirements listed while meeting the desired level of performance.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. A rifle actuation mechanism for alternately positioning a rifle between stowage within a cylindrical tube having a longitudinal axis and deployment for engaging a target, said mechanism comprising:

a cradle for holding and firing the rifle;

a yoke for connecting to said cradle;

an elevation actuator for pivoting said cradle from said yoke;

an azimuth actuator for turning said yoke about the axis for pointing to the target; and a longitudinal actuator for translating said yoke along the axis, wherein the tube contains the rifle, said cradle, said yoke and said actuators while in the stowage, and said yoke and said azimuth actuator further include outriggers to minimize friction within the tube.

2. The mechanism according to claim 1, wherein the longitudinal axis is substantially vertical, and said longitudinal actuator translates said yoke to alternately raise and lower said cradle into and out of the tube.

3. The mechanism according to claim 1, wherein the rifle is a .50 cal gun.

4. The mechanism according to claim 1, wherein said longitudinal actuator includes a pair of ball screws that flanks said yoke along the tube, said screws turning via a corresponding pair of spiral shaft servo motors.

5. The mechanism according to claim 1, wherein said azimuth and elevation actuators include respective azimuth and elevation servo motors.

* * * * *